United States Patent [19]

Nelson

[11] 4,250,533

[45] Feb. 10, 1981

[54] SECURITY SYSTEM

[76] Inventor: Avi N. Nelson, 37 Alberta Rd., Brookline, Mass. 02167

[21] Appl. No.: 40,562

[22] Filed: May 21, 1979

[51] Int. Cl.[3] ..... E05B 47/00

[52] U.S. Cl. ..... 361/172; 70/278; 340/147 MD

[58] Field of Search ..... 361/171, 172; 340/147 MD, 147 P, 147 PC, 147 CN, 149 R; 70/278

[56] References Cited

U.S. PATENT DOCUMENTS

| | | |
|---|---|---|
| 3,142,166 | 7/1964 | Adam et al. . |
| 3,392,558 | 10/1965 | Hedin et al. . |
| 3,392,559 | 10/1965 | Hedin et al. . |
| 3,660,729 | 5/1972 | James et al. . |
| 3,733,861 | 5/1973 | Lester . |
| 3,800,284 | 3/1974 | Zucker et al. . |
| 3,821,704 | 6/1974 | Sabsay . |
| 3,857,018 | 12/1974 | Stark et al. . |
| 3,979,647 | 9/1976 | Perron et al. . |
| 4,031,434 | 6/1977 | Perron et al. . |

*Primary Examiner*—Harry E. Moose, Jr.

[57] ABSTRACT

A security system uses one electronic key that contains many key codes of the user to control several different security devices. Each security device responds to a particular key code or to more than one key code in a master lock system. The key when energized presents its entire repertoire of key codes to the security device and when the security device senses its corresponding code, access is gained. The key may or may not be electrically active. The key may also include mechanical as well as electronic access control. Each security device contains a stored code and electronically correlates the stored code and input pulse patterns of the key codes. A large number of key codes are possible without compromise of system security.

12 Claims, 8 Drawing Figures

FIG 1
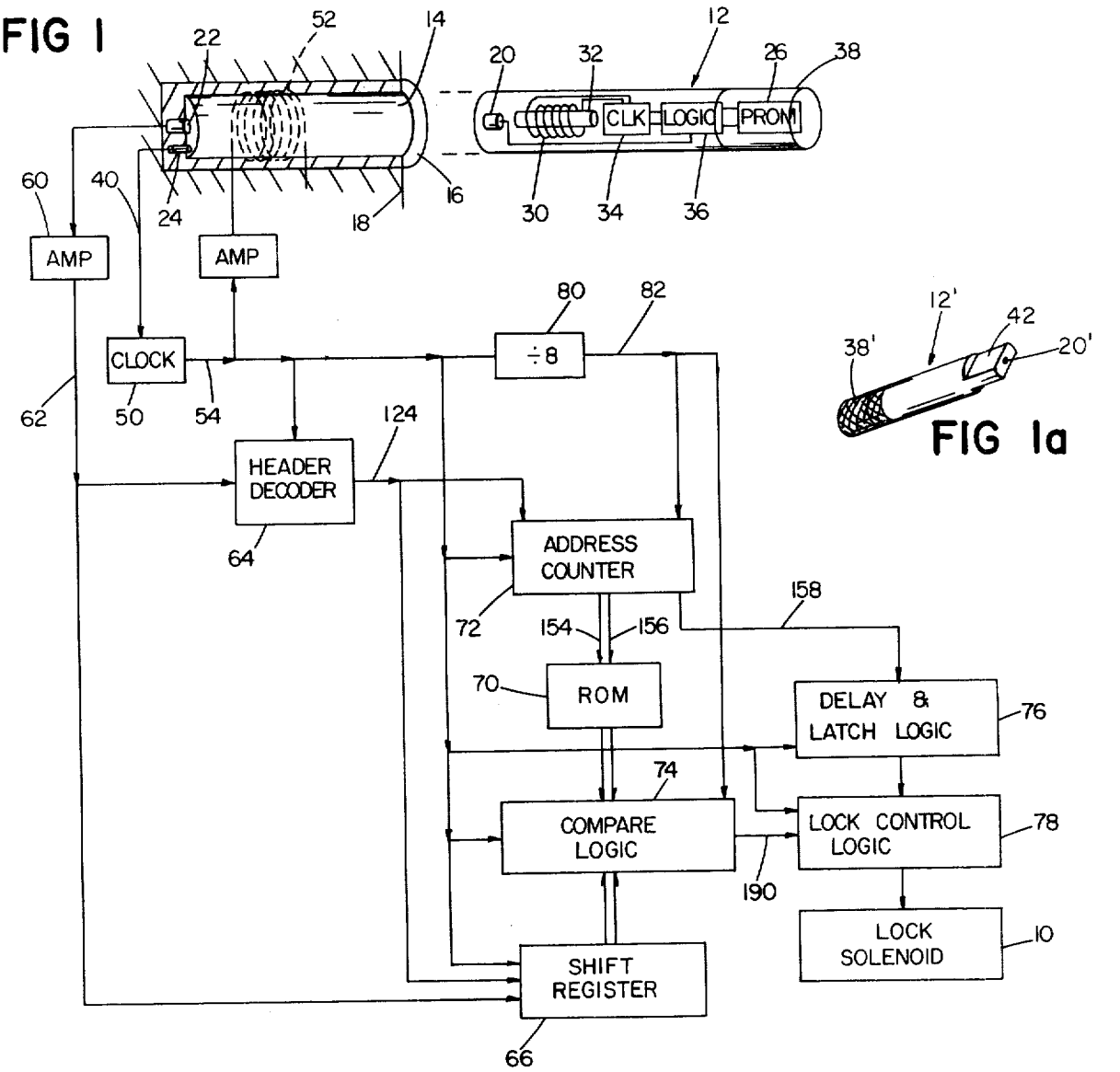
FIG 1a
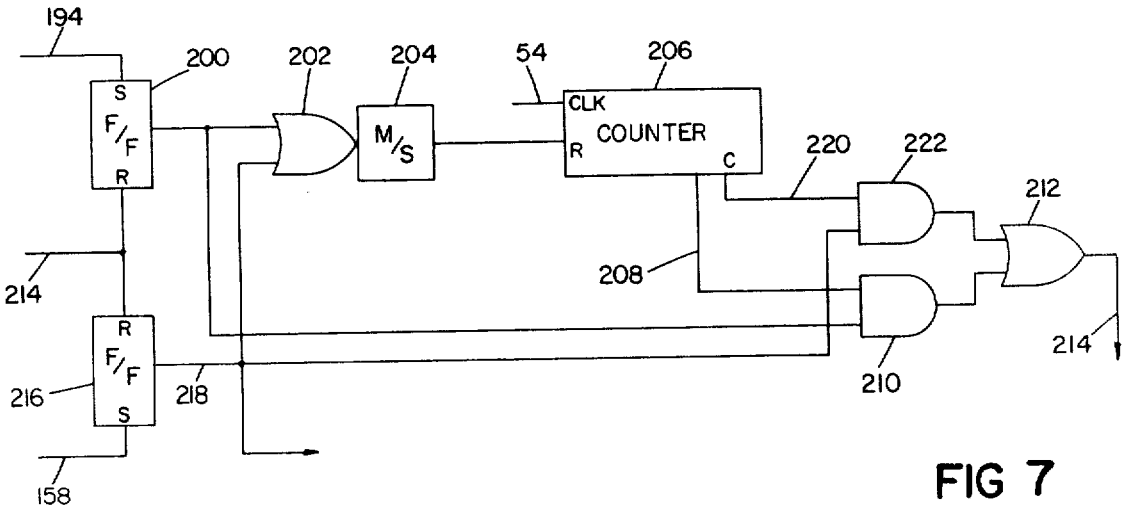
FIG 7

FIG 4
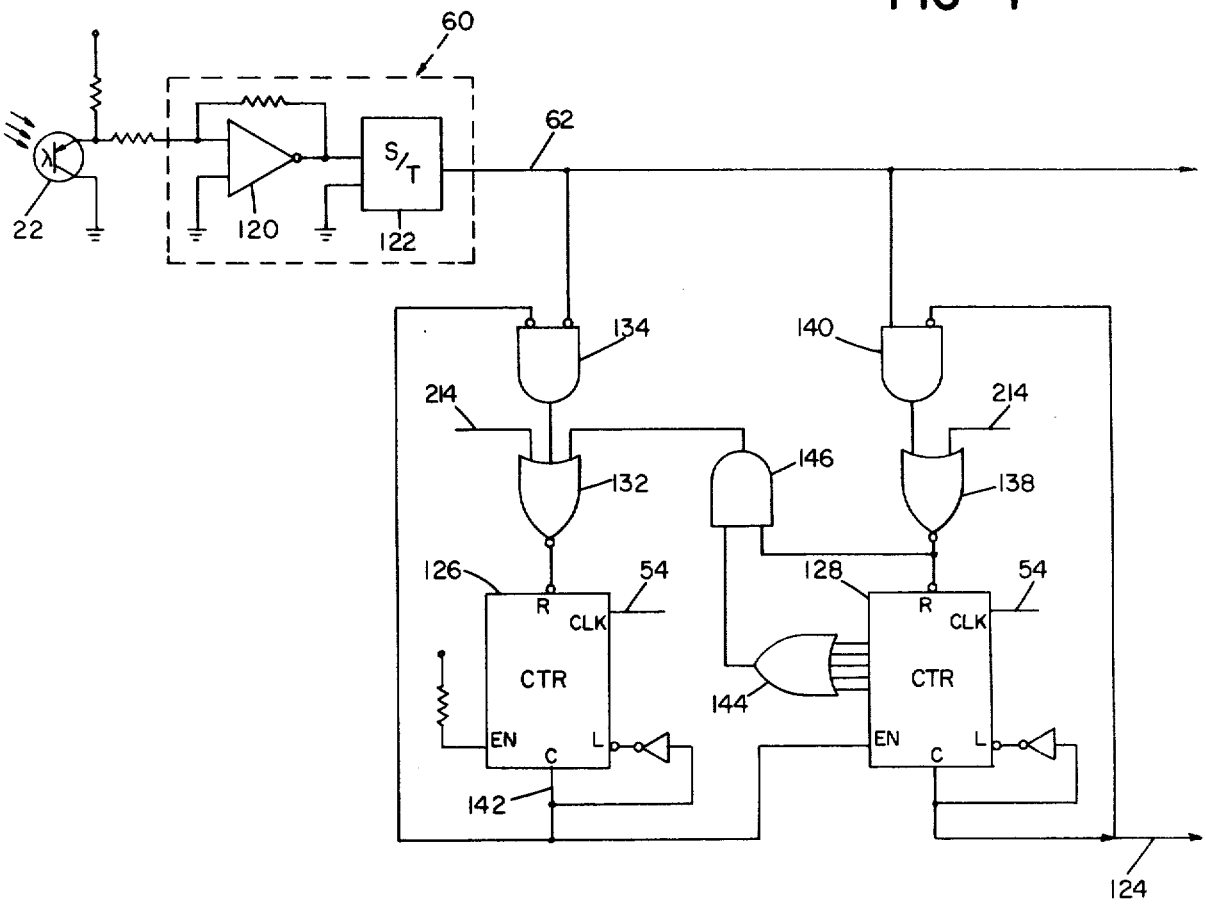
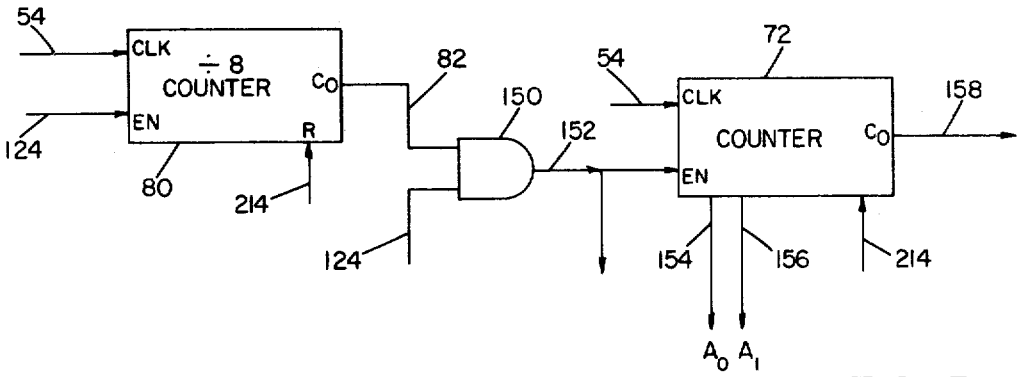
FIG 5

SECURITY SYSTEM

This invention relates to security systems and more specifically to electronically encoded security systems.

Prior electronic key and lock systems have used various encoding means such as magnetic cards or modules. Examples of such lock systems are set out in U.S. Pat. Nos. 3,392,559, 3,660,729, and 3,800,284 for example. An object of this invention is to provide an improved security system and key therefor which eliminates a need for multiple keys and retains a high degree of security.

In accordance with a feature of the invention there is provided a security system for control of a desired operation comprising a key storing a plurality of multidigit key codes that correspond to different controlled operations, a cooperating security device that includes a stored multidigit device code, compare logic for comparing the stored device code with key codes, and means responsive to detection by the compare logic of a key code that matches the device code to generate an output enabling said desired operation. Scan means responsive to presentation of the key to the cooperating security device rapidly presents a plurality of key codes stored in the key in sequence to the compare logic for comparison with the device code.

Either the key or the security device may be active or passive so long as at least one of the elements contains or has access to a power source. The key may contain a memory which can actively generate a digital pattern of the key codes or a memory which can be externally probed by an outside active device and yield the pattern of key codes. If the code pattern of the security device coincides with a key code pattern, a recognition circuit allows the desired operation, for example by direct electronic triggering. The key may also have the capability of mechanically operating the lock upon recognition of code coincidence.

The key, which may be programmed with many key codes, depending on the number of locks or security operations the user controls, runs through its repertoire of codes in sequence upon presentation of the key to a cooperating security device. The security device may contain several different codes. The security device's recognition or correlation circuit produces a response when it senses a match between a stored code and a key code presented to it.

In a particular embodiment, the security system key is a small elongated cylinder that houses a programmable read only memory that stores a qualifying header and over fifty key codes in binary form together with clock and control logic interconnected to sequentially interrogate the memory and transmit the key codes in serial pulse form to an LED transducer. The cooperating security device includes a key receptacle and a transducer that reads the key codes in response to insertion of the key in the receptacle. After the qualifying header is detected, the key codes are applied to compare logic. Further logic times the controlled operation in response to a successful comparison and locks out the security system in the absence of a successful comparison, thus discouraging tampering. The system allows security control of a variety of operations with a single key in a simple, reliable and versatile manner.

Other features and advantages of the invention will be seen as the following description of a particular embodiment progresses, in connection with the drawings, in which:

FIG. 1 is a block diagram of a security system in accordance with the invention; and FIG. 1A shows a modified key;

FIG. 4 is a schematic diagram of sensor and header decoder circuitry;

FIG. 5 is a block diagram of counter logic;

FIG. 7 is a block diagram of reset and latch logic of the system shown in FIG. 1.

DESCRIPTION OF PARTICULAR EMBODIMENT

Figure 2:
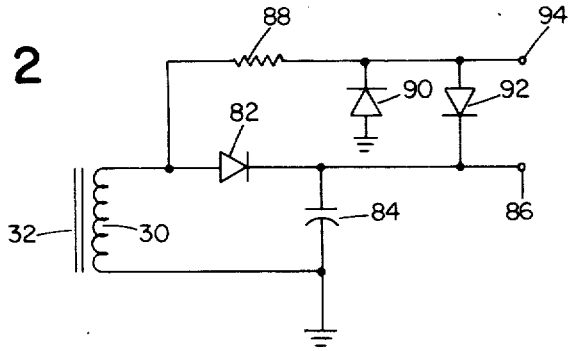
FIG. 2 is a schematic diagram of the power supply for the key of FIG. 1.

With reference to FIG. 1, the illustrated security system controls a lock solenoid 10 which, when energized, permits a desired operation such as the unlocking of an access door. The control key 12 is a small epoxy-filled cylinder that is designed to be inserted in recess 14 of security device receptacle 16 in wall 18 and has an output interface device 20—a light emitting diode—at one end. Light sensor 22 at the inner end of recess 14 is on the axis of recess 14 and is designed to interface with and respond to radiation from light source 20 when key 12 is inserted in recess 14. Sensor 24 detects the insertion of key 12.

Key 12 has a pre-programmed read only memory chip 26, and power and clock pulses are transformer coupled to the key circuitry through winding 30 on ferrite core 32. The key circuitry includes clock circuitry 34 and logic circuitry 36 connected to memory 26 and to output interface device 20. Programmable Read Only Memory 26 has a storage capacity of 256 8-bit words. The first four 8-bit words are filled with binary ONEs and the second four 8-bit words are filled with binary ZEROs. These first eight words serve as a header to notify the security device circuitry that key code sequences follow. Each key code consists of four 8-bit words sequentially located in memory 26 (each key code thus consisting of 32 bits) and memory 26 thus has capacity for storing sixty-two different key codes. Removable end piece 38 provides access to memory chip 26 to permit loading of additional key codes or changing of key codes.

Key 12 thus has capability for controlling a number of different desired operations. Each key is designed to control several different cooperating security units of the type illustrated in FIG. 1. That security unit includes a 100 kilohertz oscillator 50 which, when triggered in response to insertion of key 12 into recess 14 as signalled by a SCAN ENABLE signal over line 40 from sensor 24, provides a 100 kilohertz output on line 54 and energizes coil 52 disposed about recess 14 of receptacle 16. Key 12 then generates a serial train of data pulses which are sensed by interface sensor 22 mounted at the end of recess 14. The resulting serial data train, after amplification and shaping by amplifier 60, is applied over line 62 to header decoder 64 and input shift register 66. The security device logic also includes addressable memory 70, address counter 72, compare logic 74, delay and latch logic 76, and control logic 78. Clock pulses on line 54 are applied to header decoder 64, input register 66, address counter 72, compare logic 74, delay and latch logic 76, and control logic 78. In addition, clock pulses are applied to synchronizing divider circuit 80 which produces on line 82 a synchronizing pulse corresponding to each eighth clock pulse.

Further details of clock circuit 34 of key 12 are shown in FIG. 2. That circuitry is connected to coil 30 and includes rectifier 82 and filtering capacitor 84 which provides a DC signal at terminal 86. The clock circuit further includes resistor 88 and protective diodes 90, 92 and provides a series of clock pulses at terminal 94.

Figure 3:
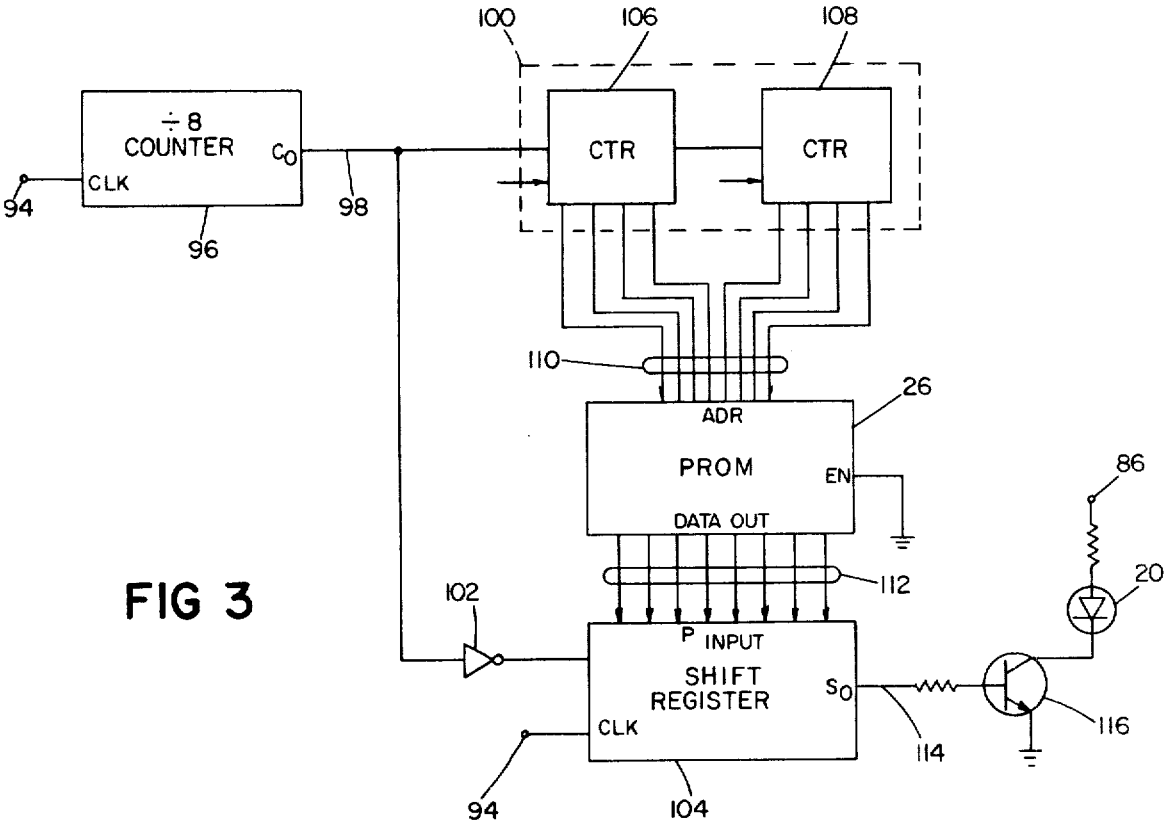
FIG. 3 is a schematic diagram of key control logic and memory.

Further details of control logic 36 of key 12 are shown in FIG. 3. Clock pulses (at 100 Khz rate) from terminal 94 drive counter 96 which, in response to every eighth clock pulse, produces a synchronizing (code byte) output on line 98 to increment address counter 100 and, through inverter 102, to load shift register 104. The PROM address counter 100 includes two 4-bit counters 106, 108 and PROM 26 is addressed over lines 110. Each addressed 8-bit data word is loaded from PROM 26 into shift register 104 over lines 112 and the following eight clock pulses from terminal 94 shift the 8-bit data word serially from register 104 over output line 114 through amplifier transistor 116 to energize infrared light-emitting diode 20. This key logic, along with the inductive power supply arrangement, eliminates the need for electrical contacts and obviates associated problems such as dirty contacts, physical abuse, and contact noise. Thus, when the key 12 is inserted in receptacle recess 14 so that the output interface diode 20 registers with input interface sensor 22 and sensor 24 is triggered, oscillator 50 causes all the stored key codes in memory 26 to be sequentially applied to the receiving interface sensor 22 essentially at the 100 kilohertz clock rate for sensing by the security circuitry.

Further details of the security circuitry may be seen with reference to FIGS. 4–7. The logic of amplifier 60 and header decoder 64 is shown in FIG. 4. Sensor 22 is a diode mounted at the end of recess 14 and picks up the serial data signals from key 12. Each output pulse signal from diode 22 is amplified by amplifier 120 and shaped by Schmitt trigger circuit 122 so that an output serial train of data pulses is applied over line 62 to the header decoder circuitry 64. That circuitry is arranged to provide a COMPARE ENABLE output signal on line 124 to indicate detection of the code header of 32 ONE-bits followed by 32 ZERO-bits (the header block). Decoder 64 includes counters 126, 128, each of which is stepped by clock pulses on line 54. The reset line 130 of counter 126 is connected through OR circuit 132 and inverter AND circuit 134 to the serial data line 62; and the reset line 136 of counter 128 is connected through OR circuit 138 and AND circuit 140 to serial data line 62. Counter 126 is stepped by each clock pulse and inverter 134 is initially conditioned by the absence of a carry signal on line 142 from the carry output of counter 126. Thus, each time a ZERO data bit is transmitted on serial data line 62, inverter 134 produces an output which is supplied through OR circuit 132 to reset counter 126. Thirty-two ONE-bits must be transmitted in sequence on line 62 before the carry bit of counter 126 is asserted on line 142. Assertion of that carry bit removes the conditioning level from inverter gate 134 and enables the second counter 128. In addition, the load line of counter 136 is asserted, loading all ONE's into that counter with each clock pulse, assuring that the carry remains asserted until counter 126 is reset.

Counter 128 operates in a manner similar to counter 126, except that the serial data is not inverted. Hence, a ONE-bit on data line 62 will reset counter 128. The stages of counter 128 are outputted through OR circuit 144 to condition AND circuit 146, and should a reset signal be produced by AND circuit 140 after OR circuit 144 has an output, counter 126 will also be reset, reinitiating the start of a header search. When thirty-two ZERO bits have been detected after counter 128 is enabled, the carry bit of counter 128 is asserted producing a COMPARE ENABLE signal on line 124. That COMPARE ENABLE signal is also fed back to remove the conditioning input from gate 140 and the load line of counter 128 is asserted, insuring that the COMPARE ENABLE signal remains asserted until the header decoder 64 is reset.

With reference to FIG. 5, a divide-by-8 counter 80, similar to key counter 96, is provided to generate address increment signals to step address counter 72. Divide-by-8 circuit includes a 4-stage counter which in response to every eighth clock pulse produces an output on line 82 which is passed (after AND circuit 150 is conditioned) as a SYNC pulse and also to step address counter 72. The two lower stages of address counter 72 provide steering outputs on line 154 and 156. Address counter 72 also functions as a scan control device, i.e., when it overflows, that signal is transmitted over on line 158 as a SEARCH FAIL signal which remains asserted until a RESET signal is generated.

Figure 6:
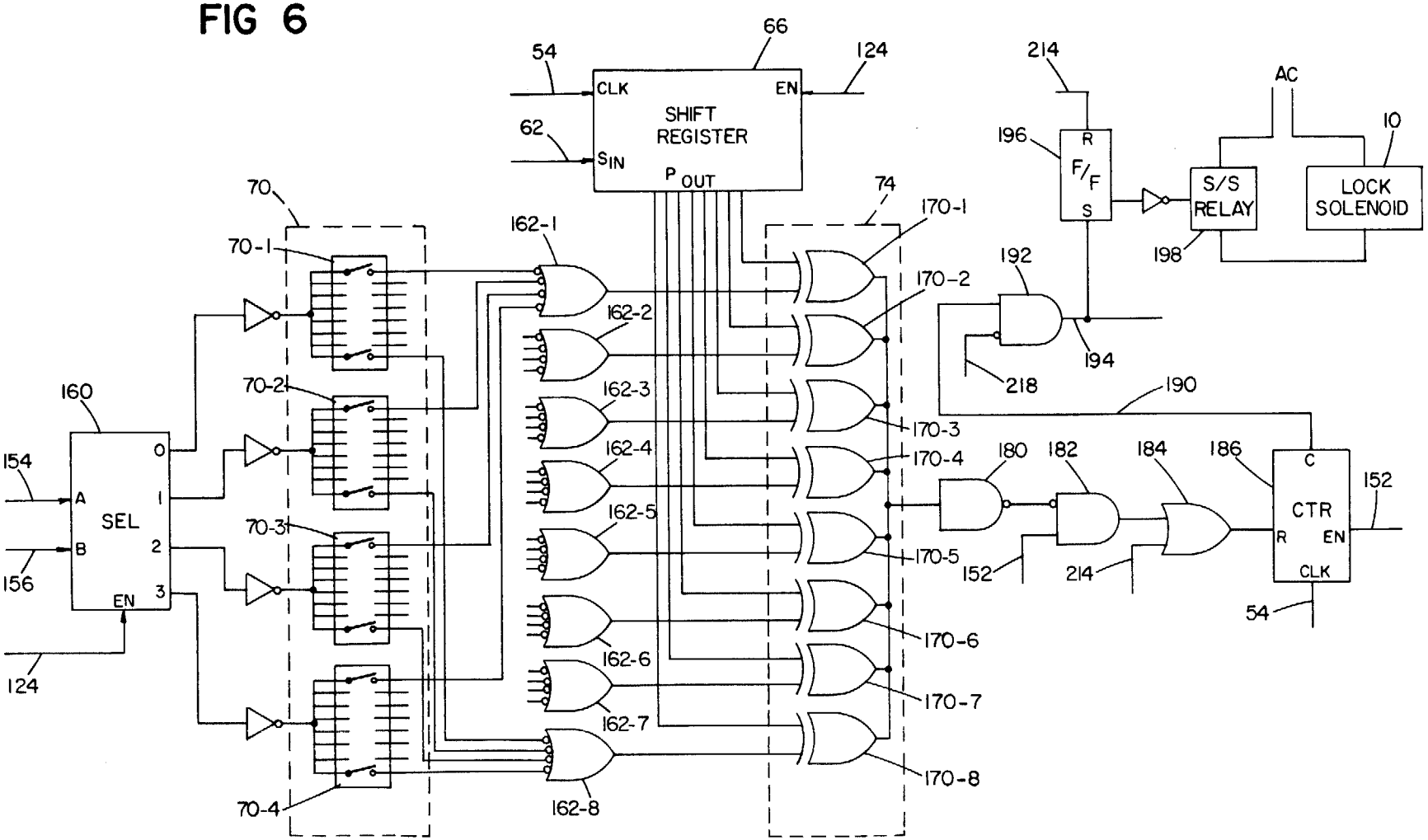
FIG. 6 is a block diagram of device memory and comparator logic.

Shown in FIG. 6 is further detail of the circuitry of input register 66, read only memory 70, compare logic 74, and control logic 78 which controls lock solenoid 10. That circuitry includes a selector circuit 160 which is conditioned by a COMPARE ENABLE signal on line 124 and responds to steering signals on lines 154 and 156 to sequentially condition DIP memory switch units 70-1–70-4. (Memory 70 may be hard wired or may be programmable as with the illustrated DIP switches.) Each of the four sets of eight code bits stored in memory 70 is applied through OR circuits 162-1–162-8 in succession to exclusive OR circuits 170-1–170-8 of compare logic 74. Each corresponding second input of exclusive OR gates 170 is connected to corresponding $P_{OUT}$ outputs of shift register 66.

After the COMPARE ENABLE signal is asserted on line 124, serial data from key 12, applied over line 62 is stored in shift register 66 and applied as a parallel data output to exclusive OR gates 170 of compare logic 74. Each 8-bit comparison is coupled through NAND circuit 180 and gate 182 which is sampled by the SYNC pulse on line 152 (each eighth clock interval). If comparison is satisfactory (all eight bits compare successfully) no output is produced by gate 182. In the event of an unsatisfactory comparison, however, AND gate 182 has an output which is applied through OR circuit 184 to reset counter 186 (unsuccessful comparison). Counter 186 is enabled by each SYNC pulse on line 152 and stepped in the absence of a reset signal from OR circuit 184. Counter 186 will generate a carry only after four successive successful comparisons are made in series. That carry is transmitted on line 190 as a successful comparison signal.

The signal on line 190 is applied to gate 192 of lock control logic 78. If that gate is conditioned, a DOOR OPEN signal on line 194 and flip flop latch 196 is set which activates solid state relay 198 to energize the lock solenoid 10.

To provide sufficient time for the user to open the door or otherwise perform the controlled operation, a delay is provided before reset by delay logic 76 illustrated in FIG. 7. The DOOR OPEN signal on line 194 sets latch 200 and the resulting output is passed through OR circuit 202 and monostable circuit 204 to reset 24 stage counter 206 which is stepped by clock pulses on line 54 providing approximately ten seconds delay before stage 20 goes high. The counter stage 20 output on line 208 is passed by conditioned AND circuit 210 and OR circuit 212 to generate a RESET pulse on line 214. In the event that a matching key code is not found in the scan interval, a SEARCH FAIL signal is generated on line 158 and sets latch 216 (scan failure). The resulting latch output on line 218 generates an OPEN INHIBIT signal which removes the conditioning input from gate 192 and is passed through OR circuit 202 to permit stepping of counter 206. The counter stage 24 output on line 220 is passed by conditioned AND circuit 222 through OR circuit 212 to provide a system RESET signal on line 214 permitting another scan cycle to be repeated. Thus, after a scan failure, the entire security system is disabled for approximately two minutes, a feature which protects against tampering.

In operation, the user inserts key 12 into receptacle 16. Insertion of the key causes sensor 24 to actuate oscillator 50 to generate clock pulses and commence read out of the key codes from the programmable memory 26 through LED transducer 20. The serial train of data pulses is sensed by photo diode 22, amplified and applied to header decoder 64 and input shift register 66. In response to successful detection of the code header, comparison of each key code byte with a corresponding code byte stored in memory 70 is initiated. Successful comparison produces an output on line 190 to operate the lock control logic and energize lock solenoid 10, permitting the desired operation to be performed. If the scan operation under the control of address counter 72 does not result in successful comparison, delay and latch logic 76 is energized as a safeguard against tampering.

It will be appreciated that the key 12 can take many forms and may include a mechanical lock operator position 42, for example, as indicated in FIG. 1A. Rotation of key 12', after DOOR OPEN signal (line 194) is asserted, operates a mechanical lock or latch member that has been released by lock solenoid 10. It will be apparent that code data may be translated from the key to the security device in a variety of manners and in various forms. The several security devices for use with a single key may control diverse functions including conventional lock mechanisms for the user's house, office, and automobile, for example as well as other security mechanisms such as those for monetary transfer or other banking or credit transactions, for example. Enhanced security of certain operations is possible with the system of the invention as the controlled device, e.g., lock solenoid 10 may be remote from receptacle 16. For example, in automobile ignition systems, the key receptacle may be on the steering column and the ignition switch in the motor compartment accessible only through the separately locked hood. Supplemental control functions may be provided in systems in accordance with the invention as for example, the provision of a watch clock record or similar record of key codes through which access was obtained to the controlled or supervised operation.

Therefore, while a particular embodiment has been shown and described, other embodiments will be apparent to those skilled in the art and therefore it is not intended that the invention be limited to the disclosed embodiment or to details thereof and departures may be made therefrom within the spirit and scope of the invention.

What is claimed is:

1. A security system for control of a desired operation comprising a key storing a plurality of multidigit key codes, each said key code corresponding to a different controlled operation, a cooperating security device including a stored multidigit device code, compare logic for comparing said stored device code with key codes, means responsive to detection by said compare logic of a key code that matches said device code to generate an output enabling said desired operation, and scan means responsive to presentation of said key to said cooperating security device for rapidly presenting a plurality of key codes stored in said key in sequence to said compare logic for comparison with said device code.

2. The system of claim 1 wherein said key includes a programmable read only memory for storing said key codes.

3. The system of claim 1 wherein said security device includes a programmable memory for storing said device code.

4. The system of claim 1 wherein said scan means includes means in said security device for interrogating said key and causing said key to sequentially transmit said key codes to said security device.

5. The system of claim 1 wherein said key includes a code output interface transducer and said security device includes a cooperating input interface sensor arranged to mate with the output interface transducer of said key for translation of key code data from said key to said security device.

6. The system of claim 5 wherein said key code data are translated in serial pulse form to said input interface sensor.

7. The system of claim 1 wherein said key further includes a mechanical operator portion for performing a mechanical operation in response to said enabling output.

8. The system of claim 1 and further including delay logic responsive to presentation of said key to said security device for inhibiting operation of said scan means after said plurality of key codes have been presented to said compare logic.

9. The system of any one of claims 1, 7, or 8 wherein said security device includes a receptacle and a code transducer in said receptacle and said key includes a casing that carries an output transducer arranged for insertion into said receptacle for juxtaposition with said code transducer.

10. The system of claim 9 wherein said key has a cylindrical body portion, said output transducer is a single infrared LED and is coaxially located at one end of said cylindrical body portion, and said cooperating code transducer is a radiation sensor that responds solely to radiation in the infrared region.

11. A key for use with a cooperating security device that controls a desired operation and includes a stored multidigit device code, compare logic for comparing said stored device code with key codes, and means responsive to detection by said compare logic of a key code that matches said device code to generate an output enabling said desired operation, said key including memory means storing a plurality of multidigit key codes, and means responsive to presentation of said key to said cooperating security device for rapidly presenting a plurality of key codes stored in said key in sequence to said security device for comparison with said device code.

12. The key of claim 11 and further including an interface transducer, said memory means is arranged to store said key codes in binary form and the bits of each said key code are presented serially to said interface transducer for transmission to said cooperating security device.

* * * * *